United States Patent [19]

Bialczak

[11] 4,080,208

[45] Mar. 21, 1978

[54] PHOTOSENSITIVE DIAZOMICROFILM ADAPTED TO BE READABLE BUT NONREPRODUCIBLE UPON PROCESSING

[75] Inventor: Edward C. Bialczak, Guilford, Conn.

[73] Assignee: Addressograph Multigraph Corporation, Cleveland, Ohio

[21] Appl. No.: 700,357

[22] Filed: Jun. 28, 1976

Related U.S. Application Data

[60] Division of Ser. No. 540,426, Jan. 13, 1975, abandoned, which is a continuation-in-part of Ser. No. 324,727, Jan. 18, 1973, abandoned.

[51] Int. Cl.[2] ..... G03C 1/54; G03C 1/80; G03C 1/60

[52] U.S. Cl. ..... 96/75; 96/49

[58] Field of Search ..... 96/75, 91 R, 49

[56] References Cited

U.S. PATENT DOCUMENTS

| | | | |
|---|---|---|---|
| 3,069,268 | 12/1962 | Herrick | 96/75 |
| 3,260,599 | 7/1966 | Lokker | 96/49 |
| 3,269,839 | 8/1966 | Altman | 96/75 |
| 3,313,626 | 4/1967 | Whitney | 96/75 |
| 3,365,293 | 1/1968 | Haefeli et al. | 96/75 |
| 3,370,949 | 2/1968 | Van Groenland | 96/75 |
| 3,525,618 | 8/1970 | Keller et al. | 96/75 |
| 3,536,490 | 10/1970 | Hochberg | 96/75 |
| 3,632,344 | 1/1972 | Morow et al. | 96/75 |
| 3,640,714 | 2/1972 | Champ et al. | 96/75 |
| 3,661,591 | 5/1972 | Reed | 96/75 |
| 3,754,919 | 8/1973 | Sobel et al. | 96/84 |
| 3,904,420 | 9/1975 | Hunter | 96/75 |

FOREIGN PATENT DOCUMENTS

| | | | |
|---|---|---|---|
| 469,194 | 11/1950 | Canada | 96/75 |
| 38-12084 | 7/1963 | Japan | 96/91 R |
| 492,795 | 9/1938 | United Kingdom | 96/91 R |
| 645,825 | 11/1950 | United Kingdom | 96/49 |

OTHER PUBLICATIONS

Dinaburg, M. S., "Photosensitive Diazo Cpds", The Focal Press, 1964, pp. 145–147.

Kosar, J., "Light-Sensitive Systems", J. Wiley & Sons, 1965, pp. 197–199.

*Primary Examiner*—Charles L. Bowers, Jr.

*Attorney, Agent, or Firm*—Michael A. Kondzella

[57] ABSTRACT

A translucent sheet bearing opaque graphic intelligence thereon coated with a film which absorbs ultraviolet light, whereby the passage of visible light therethrough projects a legible image while light in the ultraviolet range is not transmitted so that diazotype copies cannot be produced of the graphic intelligence.

2 Claims, No Drawings

PHOTOSENSITIVE DIAZOMICROFILM ADAPTED TO BE READABLE BUT NONREPRODUCIBLE UPON PROCESSING

This is a division, of application Ser. No. 540,426 filed Jan. 13, 1975, now abandoned, which is a continuation-in-part of application Ser. No. 324,727, filed Jan. 18, 1973, now abandoned.

This invention relates to microfilm or microfiche members which transmit visible light and project legible images on screens, but which absorb and do not transmit ultraviolet light which is commonly used in producing additional copies of the microfilm or microfiche. More particularly this invention relates to microfiches which are treated with yellow dyes or pigments which block the transmission of ultraviolet light so that copies thereof cannot be produced by diazotype copying.

BACKGROUND OF THE INVENTION

Microfilming, as a documentary reproduction process, is in widespread and increasing use. A microfilm copy may be defined as a transparent photocopy at a reduction sufficient that optical enlargement is required for normal reading and with resolving power sufficient for accurate recording of textual and tonal detail. Normal reductions are from 12 to 42 diameters, although higher reductions are feasible.

Microimages are usually generated first on silver halide film in a camera, by photographing a printed document or the face of a cathode ray tube, for example. The photographic film may be handled in roll form, typically 16 or 35 mm. in width, or in sheets referred to as microfiche. A microfiche is a sheet or card, typically about 4 × 6 inches, on which the recorded frames are aligned in rows and columns. The microfiche format is finding increasing favor in the field because of the convenience of organizing, filing, and retrieving desired records.

For further distribution of microfilmed records, direct duplicate copies of the original silver halide films are frequently produced. The most convenient and inexpensive means of making such duplicate copies is by contact exposure with film materials whose light-sensitive ingredient is a diazonium salt. These copy films may utilize the conventional diazo process, yielding direct positive dye images, or the vesicular process, in which the image is composed of microscopic gas bubbles, and the copy is a reversal of the original. In both cases the exposure requires radiation in the violet and near ultraviolet portion of the spectrum. A variety of equipment is available for microfilm duplication, roll to roll, roll to sheet and sheet to sheet.

OBJECTS OF THE INVENTION

Producers of microfilm and microfiche materials sell copies for use in microfilm projectors and microfiche readers which project visible images for users to read. From the point of view of the producers, it is undesirable for others to be able to produce graphic copies of the written or illustrative materials on microfilm or microfiche. In fact, such graphic copies may constitute copyright infringement. It is therefore an object of this invention to provide translucent graphic materials which are readable by transmitted visible light but which are opaque to ultraviolet light and hence cannot be copied on diazotype materials.

It is another object of the invention to provide nonreproducible translucent graphic materials which are suitable for microfilm and microfiche.

It is a further object to provide microfilm and microfiche materials which are substantially opaque to ultraviolet light.

These and other objects are apparent from and are achieved in accordance with the following disclosure.

BRIEF DESCRIPTION OF THE INVENTION

The present invention comprises transparent or translucent sheets, webs or films adapted for carrying graphic intelligence in the form of an opaque image thereon, which sheets, webs or films will transmit visible light and absorb ultraviolet radiation. In one of its more particular aspects, this invention is directed to microfilm or microfiche copies of documentary information having a separate ultraviolet blocking coating thereon. The separate coating contains a yellow dye or pigment which prevents the transmission of ultraviolet radiation, particularly radiation of a wave length from about 3,500 to about 5,500 angstroms. As a result, the microfilm or microfiche can be viewed using incandescent light, but diazotype copies thereof cannot be made.

DETAILED DESCRIPTION OF THE INVENTION

The sheets or films of which the microfilms and microfiche are produced are conventionally cellulose acetate or polyester sheets or films. Any of the operative translucent plastic materials which are suitable for microfilm are suitable in this invention.

The photographic images applied to the translucent or transparent sheets or films are also conventional and include silver halide images, xerographic toner images, diazotype images and the like. Conventional microfilm and microfiche copies can be used in this invention.

It will be understood that in describing the blocking effect of the ultraviolet radiation attributable to the novel separate coatings described herein, that the useful blocking range will depend on the spectral absorption curve of the coating involved. Such useful blocking effect occurs not only at the point of peak absorption for the material but may exhibit significant degrees of absorption on either side of the peak absorption value.

The yellow dye or pigment coating can be applied to either side of the sheet or film, but of necessity must be adjacent thereto. Thus the separate ultraviolet blocking coating can be applied immediately beneath a light-sensitive diazotype coating or to the side opposite that to which the diazotype coating is applied, that is, the back side of the transparent substrate or film. To apply an ultraviolet blocking coating as part of the light-sensitive diazotype coating or on top of the diazotype coating will not produce an operable structure.

The percentage of ultraviolet radiation transmitted through the substrate (film or sheet) bearing the yellow dye or pigment should not be greater than about 20% and preferably should be in the range of from zero to five percent. At fifteen to twenty percent ultraviolet radiation transmittance, the microfilm or microfiche will require an exposure time of at least five minutes to produce a diazotype copy with a 20 ampere rated carbon arc at an exposure distance of 15 inches. Such an exposure time, in this field of art, is deemed too great to be commercially practicable for copying purposes. At lower transmittance percentages, the exposure times are greater and hence even less acceptable.

When the image on the microfilm or microfiche is a diazotype image, it is desirable that it be formed by a blue azo-dye. With a blue azo-dye image on one side of the film and a yellow dye either on the other side or just underlying the azo-dye image, the resulting image when viewed on a microfilm projector or reader is a sharp black image of high legibility.

The yellow dyes and pigments which are operative in this invention are those which have a spectral absorption curve showing significant absorption of radiation having a wave length in the range of from 3,500 to 5,500 angstroms. As discussed hereinabove, such spectral transmission curves show varying degrees of absorption on either side of a maximum absorption point on such a curve which means the dye or pigment can effectively block transmittance of ultraviolet radiation wave lengths other than the peak absorption wave length. Included are diazo dyes and toners from benzidine and its derivatives such as RBH transparent pigment dyes typified by benzidine yellow 1178 (Color Index 21090)

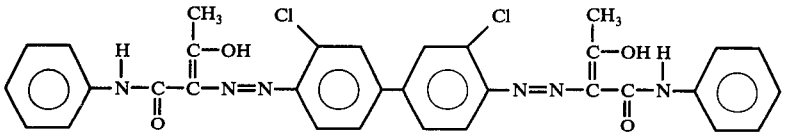

and fast benzidine yellow 1193 (Color Index 12230). Other operative dyes and lakes are orange lake 1095, yellow lake 1076, midas gold 6289, fast benzidine yellow 5448, yellow 5468, green gold 1166 (Color Index 12600), princess yellow 1198, and orange 5471. The foregoing dyes are available from Inmont Corporation. Also suitable are sunset gold toner 1281-10 (Color Index Y-83) available from Harshaw Chemical Company and benzidine yellow YB-5722 supplied by Allied Chemical Corporation. Yellow pigments which are suitable include oriole yellow, golden yellow LF and golden yellow F (YT-174, YT-185 and YT-189) of Holland Color & Chemical Company. Others include yellow pigments identified by Color Index Nos. yellow 12, 13, 14 and 15; pigment orange, Color Index 13; pigment red, Color Index 38; and pigments yellow, Color Index 84, 87, 88, 89 and 90.

In the practice of this invention, the end results as far as blocking ultraviolet radiation is concerned are obtained by applying to the film or sheet material a solution of the dye or a suspension of the pigment having a concentration of from 1% to 10% by weight of the treating solution. One or more applications may be appropriate in order to achieve the necessary level of ultraviolet transmittance which is preferably below 10%.

The invention is disclosed in further detail by the following examples which are illustrative of the materials and methods used. It will be readily understood that various modifications of materials, operating conditions and the like may be made without departing from the invention as described herein.

EXAMPLE 1

Polyester film (ICI X-303) was subcoated by wire bar with a solution of 8 grams of ½-second cellulose acetate in 100 grams of acetone to provide an anchor coat 0.3 mil thick to accept a diazo coating. A diazo solution of 1.2 grams of sulfosalicylic acid, 0.5 g. of zinc chloride, 0.4 g. of thiourea, 1.0 g. of alpha naphthalide of 2,3-oxynaphthoic acid and 1.3 g. of the half zinc chloride salt of 2,5-diethoxy-4-morpholinobenzenediazonium chloride were dissolved in 45 g. of methanol and 55 g. of acetone. The diazo solution was applied to the polyester film by the dip bead method. Then an ultraviolet-absorbing solution of 15 grams of Inmont RBH fast benzidine yellow 1193 pigment in 85 g. of acetone was applied as a backcoat by the dip bead method. The ultraviolet transmittance of this film was less than 0.2%.

EXAMPLE 2

Polyester film was coated with a solution of 15 g. of fast benzidine yellow (Inmont RBH 1193) in 60 g. of methyl ethyl ketone and 25 g. of methyl cellosolve, then overcoated with a diazo coating as follows:

| | |
|---|---|
| Methyl ethyl ketone | 75 ml. |
| Methyl cellosolve | 21 ml. |
| Methyl cellosolve acetate | 21 ml. |
| Half-second cellulose acetate propionate (Eastman Kodak) | 4 g. |
| Elvacite 2009 (E.I. DuPont) | 1 g. |
| Citric acid | 0.1 g. |
| $SnCl_4$ | 0.15 g. |
| Alpha naphthalide of 2,3-oxynaphthoic acid | 0.75 g. |
| Diresorcyl sulfide | 0.04 g. |
| 2,5-diethoxy-4-morpholinobenzenediazonium fluoborate | 1.2 g. |

EXAMPLE 3

By the procedure of Example 1, a number of yellow dyes and pigments were tested as ultraviolet absorbents on polyester film coated with a two-component diazotype coating. The following results were obtained:

| Dye, Pigment, or Pigment Dispersion | % Solution | Color Index | 18A Filter Density | % H.V. Transmittance | Readable Reprint at | Operable Absorbtion Range (Angstroms) |
|---|---|---|---|---|---|---|
| Orange Lake 1095 | 4.5 | — | 0.78 | 16.5 | >5 min. <10 min. | 3500 - 5500 |
| Fast Benzidine Yellow 1193 | 4.5 | 12230 | 2.90 | <.2 | >15 min. | 3600 - 5100 |
| Yellow Lake 1076 | 5.0 | — | 2.40 | .4 | >15 min. | 3500 - 5000 |
| Benzidine Yellow 1178 | 3.75 | 21090 | 3.00 | .1 | >15 min. | 3500 - 5100 |
| Midas Gold 6289 | 5.0 | — | 1.52 | 3.0 | 5 min. | No Data |
| Midas Gold 6289 | 6.5 | — | 1.82 | 1.5 | 5 min. | No Data |
| Midas Gold 6289 | 7.25 | — | 2.20 | <.7 | 15 min. | No Data |
| Fast Benzidine | | | | | | |

-continued

| Dye, Pigment, or Pigment Dispersion | % Solution | Color Index | 18A Filter Density | % H.V. Transmittance | Readable Reprint at | Operable Absorbtion Range (Angstroms) |
|---|---|---|---|---|---|---|
| Yellow 1193 Fast Benzidine | 3.6 | 12230 | 2.80 | <.2 | >15 min. | 3700 - 5100 |
| Yellow 1193 Fast Benzidine | 2.7 | 12230 | 2.65 | <.3 | >15 min. | 3700 - 5100 |
| Yellow 1193 Fast Benzidine | 1.8 | 12230 | 1.45 | 3.5 | 15 min. | 3700 - 5100 |
| Yellow 5448 | 2.7 | 12230 | 1.91 | 1.2 | >15 min. | No Data |
| Yellow 5468 | 2.7 | — | 0.69 | 20.4 | 5 min. | 3900 - 5100 |
| Green Gold 1166 | 2.7 | 12600 | 2.12 | 0.8 | 10 min. | 3700 - 4500 |
| Yellow Lake 1076 | 2.7 | — | 0.82 | 15.2 | 5 min. | 3500 - 5000 |
| Princess Yellow 1198 | 2.7 | — | 2.72 | 0.2 | >15 min. | 3500 - 5100 |
| Benzidine Yellow 1178 | 2.7 | 21090 | 2.96 | <0.2 | >15 min. | 3500 - 5200 |
| Orange 5471 | 2.7 | — | 0.88 | 13.2 | 5 min. | 3600 - 5500 |
| Sunset Gold Toner 1281-10 | 2.7 | Y-83 | 2.90 | <0.2 | >15 min. | No Data |
| Benzidine Yellow YB5722 | 2.7 | 21090 | 1.88 | 1.5 | 15 min. | No Data |

In the foregoing table, the last two dyes were obtained as dry powders and dissolved in a solvent of the following formula:

| | |
|---|---|
| Methyl ethyl ketone | 40 ml. |
| 10% solution of nitrocellulose in methyl ethyl ketone | 35 ml. |
| Methyl cellosolve | 20 ml. |
| Methyl cellosolve acetate | 20 ml. |
| Dibutyl phthalate | 0.5 ml. |

The other dyes were obtained in a solvent vehicle and were diluted to the indicated percentage concentration prior to application.

This invention has been described with respect to a limited number of specific embodiments. However, it is intended that alternative compositions and methods can be used and it is to be understood that this invention is not to be limited except in accordance with the claims appended hereto.

I claim:

1. A film adapted for the production of a positive azo dye image and transmitting no greater than about 20% of electromagnetic radiation in the ultraviolet range consisting essentially of a translucent or transparent base, a benzidine yellow dye coating one side of said base, said benzidine yellow dye being one which absorbs electromagnetic radiation in the range of 3,500 to 5,500 angstroms and a two component diazotype coating comprising a light-sensitive diazonium salt, an azo coupler and an acidic stabilizer, said diazotype coating being coated upon said dye or upon the side of said base opposite from the side coated with said dye.

2. A film according to claim 1 wherein said positive azo dye image is formed from a blue azo dye.

* * * * *